US008510881B1

(12) United States Patent
Lee

(10) Patent No.: US 8,510,881 B1
(45) Date of Patent: Aug. 20, 2013

(54) HOSPITAL BED WITH RETRACTABLE MATTRESS SECTION AND REMOVABLE BED PAN

(76) Inventor: Han Young Lee, Plano, TX (US)

( * ) Notice: Subject to any disclaimer, the term of this patent is extended or adjusted under 35 U.S.C. 154(b) by 0 days.

(21) Appl. No.: 13/470,245

(22) Filed: May 11, 2012

(51) Int. Cl.
*A61G 7/02* (2006.01)

(52) U.S. Cl.
USPC ..... 5/604; 5/308

(58) Field of Classification Search
USPC ..... 5/604–606, 695, 308, 613; 4/300–301
See application file for complete search history.

(56) References Cited

U.S. PATENT DOCUMENTS 1,407,631 A * 2/1922 Brown ..... 5/604

* cited by examiner

*Primary Examiner* — Fredrick Conley
(74) *Attorney, Agent, or Firm* — Mark W Handley

(57) ABSTRACT

A hospital bed (12) is provided having a slidably extendable drawer (14) in which a removable bed pan (16) is disposed. The drawer (14) fits under the mid-section of the bed, and the bed is provided with a mattress (20) having stationary cushions (22) and moveable cushions (24). The moveable cushions (24) are located in a central portion of the mattress (20) and configured for sliding out from underneath a person lying on the bed (12). A pair of cushion guide tracks (56) are provided which are have a serpentine profile, such that sections (48, 50) of the movable cushions (24) may be lowered and them moved from beneath the body of a person for accessing a central opening (26) beneath which the removable bed pan (16) is located when the drawer (14) is inserted fully into the mid-section of the bed (12).

18 Claims, 10 Drawing Sheets

HOSPITAL BED WITH RETRACTABLE MATTRESS SECTION AND REMOVABLE BED PAN

TECHNICAL FIELD OF THE INVENTION

The present invention relates in general to hospital beds, and in particular to a bed having a retractable mattress section with a removable bed pan.

BACKGROUND OF THE INVENTION

Persons have often been impaired due to sickness and injury, and have been restricted to bedridden states. Such impairment has at times resulted in the inability of persons to easily remove themselves from a bed to perform such functions as going into a restroom. Removable pans such as bed pans have been provided for enabling relief of bedridden persons. Some prior art beds have been provided with integrated toilet facilities. Prior art hospital beds have provided with complex mechanical structures for allowing a person access to toilet facilities integrated within the bed. However, these type hospital beds are often very complex and expensive, and not easily affordable for home use, or for economically providing a large number for hospital, nursing home and long term care facilities.

SUMMARY OF THE INVENTION

A hospital bed is provided having a slidably extendable drawer in which a removable bed pan is disposed. The drawer fits under the mid-section of the bed, and the bed is provided with a mattress having stationary cushions and moveable cushions. The moveable cushions are located in a central portion of the mattress and configured for sliding out from underneath a person lying on the bed. A pair of cushion guide tracks are provided which are have a serpentine profile, such that sections of the movable cushions may be lowered from beneath the body of a person for accessing a central opening beneath which the removable bed pan is when the drawer is inserted fully into the mid-section of the bed.

DESCRIPTION OF THE DRAWINGS

For a more complete understanding of the present invention and the advantages thereof, reference is now made to the following description taken in conjunction with the accompanying Drawings in which

FIG. 1 is a perspective view of the hospital bed of the present invention;

FIG. 2 is a perspective view of a movable cushion portion of a mattress for the removable hospital bed;

FIG. 3 is a forward end view of the removable cushion portion of FIG. 2;

FIG. 4 is a longitudinal section view of the hospital bed taken along section line 4-4, showing the bed with the movable cushions fully installed in a retracted position for supporting a person;

FIG. 5 is a longitudinal section view of the hospital bed taken along section line 4-4, after the movable cushions have been moved to an extended position allowing a person in the hospital bed to access the bed pan;

FIG. 6 is a longitudinal section view showing the cushion guide tracks with the movable cushions shown in a fully inserted position;

FIG. 7 is a longitudinal section view taken along section line 4-4 of FIG. 1, showing the movable cushions partially removed and tracking along the cushion guide tracks;

FIG. 8 is a partial side elevation view of a mattress plate structure for supporting the movable cushions in the hospital bed;

FIG. 9 is a side elevation view of the hospital bed showing a top cushion moved to an upright position, a first motor for moving the top cushion between downward and upright positions, and a second motor for moving moveable cushions between inward and extended positions;

FIG. 10 is a perspective view of the hospital bed of an alternative embodiment the present invention;

FIG. 11 is a side elevation view of the alternative embodiment of the hospital bed showing the top cushion in an upright position, a first motor for moving the top cushion between downward and upright positions, and a second motor for moving moveable cushions between inward and extended positions;

DETAILED DESCRIPTION OF THE INVENTION

Figure 1:
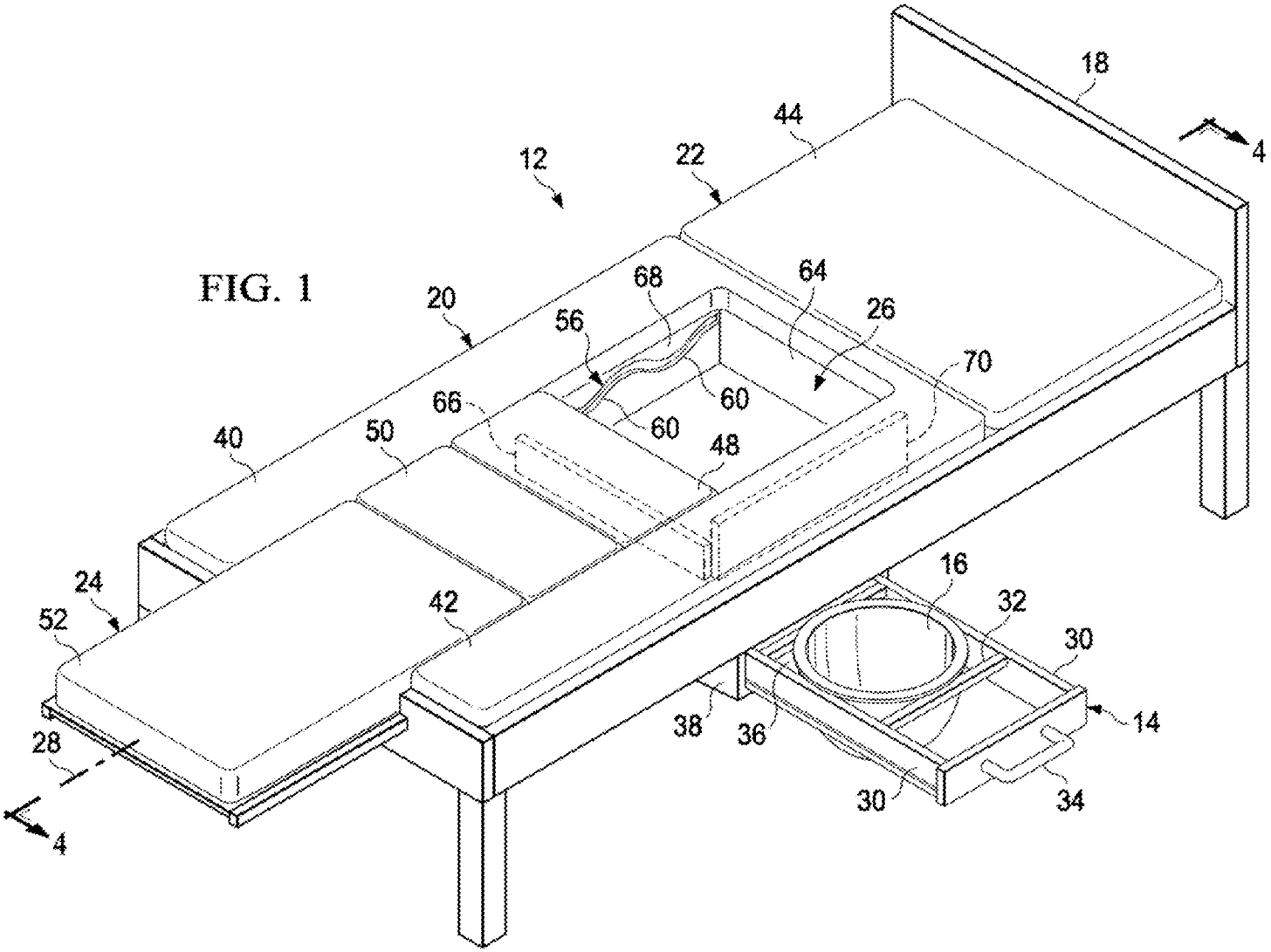
FIGS. 1 through 11 show various aspects for hospital bed with retractable mattress section and removable bed pan devices made according to the present invention, as set forth below.

FIG. 1 is a perspective view of the hospital bed 12 of the present invention. The hospital bed 12 has a drawer 14 which slidably extends outward from the side of the hospital bed. The drawer 14 moves transverse to the longitudinal length of the bed. A removable bed pan 16 is removably mounted within the drawer 14. The bed has a frame 18 to which a mattress 20 is mounted. The mattress 20 includes a plurality of stationary cushions 22 and moveable cushions 24. The moveable cushions 24 slidably extend from along a horizontal plane and a central longitudinal axis 28 to extend rearward or outward from the foot of the bed 12, to expose a central opening 20. The central opening is located in a mid-section of the hospital bed 12. The bed pan 16 may be accessed through the central opening 26. The drawer 14 preferably has drawer slides 30 with a rack frame 32 defining a pan aperture 36 within which the removable bed pan 16 is removably received. A pull handle 34 is provided on the outward side of the drawer 14. Drawer mounts 38 are provided for slidingly securing the drawer 14 within the bed 12 by means of the drawer slides 30.

The stationary cushions 22 of the mattress 20 include side cushions 40 and 42 and a top cushion 44 for supporting the upper torso of a person. The moveable portion of the mattress 20 include an inner cushion 48, a middle cushion 50 and an outward cushion 52. Preferably, the inner cushion 48 and the middle cushion 50 are much shorter lengths than the outward cushion 52 to allow the inner cushion 48 and the middle cushion 50 to travel along the cushion guide tracks 56 (one shown) by means of rollers 58. The cushion guide tracks 56 have double loops 60. The guide tracks 56 may be provided by rails, such as formed cylindrical rods, or by forming U-shaped grooves, or the like, into the sides of the bed 12, such as in the splash plates 68 and 70.

Figure 2:
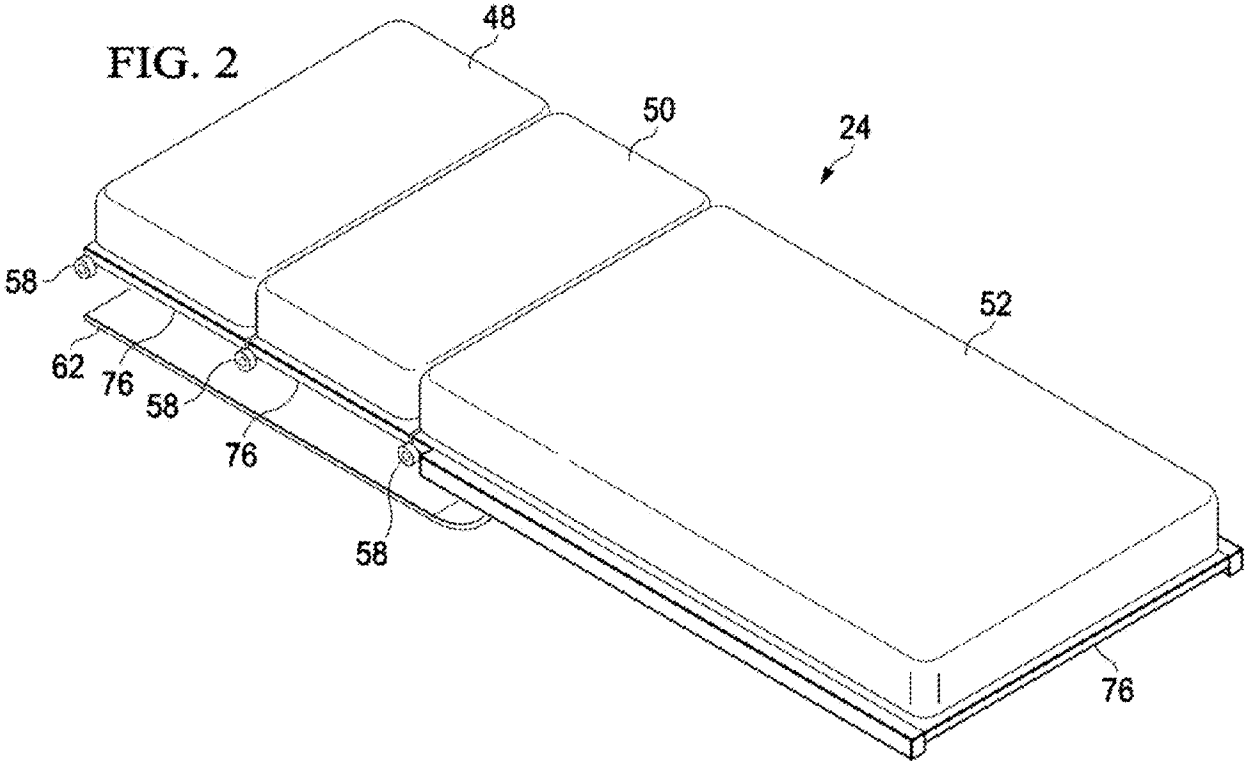

FIG. 2 is a perspective view of a movable cushion portion 24 of a mattress 20 for the removable hospital bed 12. Three plates 74 pivotally secured together in an edge to edge arrangement, preferably with lengths of the three plates 70 aligned to extend in a single plain. The adjacent edges of the plates 76 are pivotally secured together. The inner cushion 48, a middle cushion 50 and an outward cushion 52 are mounted to respective ones of the plates 76. Three crossbars 82 extend adjacent to forward edges of the three plates 76, transverse to the longitudinal axis 28 of the hospital bed 12. Cushion rollers 58 are mounted to the opposite terminal ends of the crossbars 82.

Figure 3:
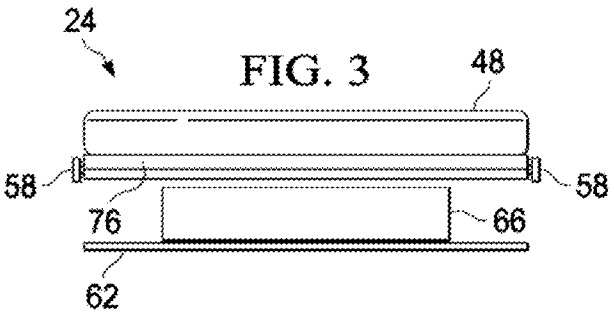

FIG. 3 is a forward end view of the removable cushion portion 24 of FIG. 2. A rearward splash plate 66 is mounted to the forward end of inward cushion 48. The forward most crossbar 82 is shown extending across the forward end of the inward cushion 48.

Figure 4:
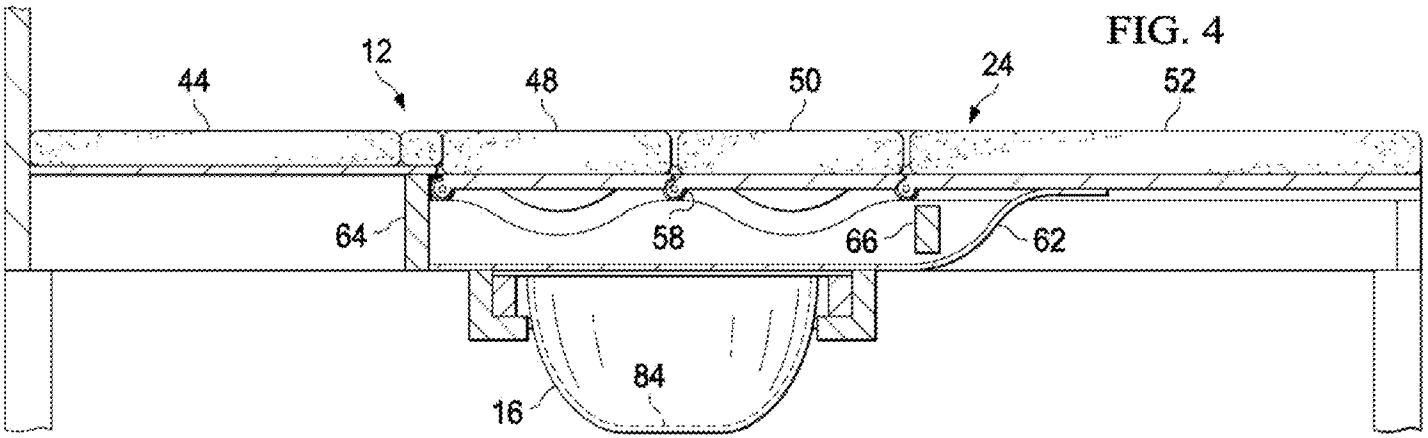

FIG. 4 is a longitudinal section view of the hospital bed 12 taken along section line 4-4 of FIG. 2, showing the bed 12 with the movable cushions 24 fully installed and moved forward into a retracted position for supporting a person and covering the opening 26. The bed pan 16 is shown located in the drawer 14, beneath the central opening 26. The forward splash plate 64 and the rearward splash plate 66 are shown. The pan cover 62 is shown extending beneath the moveable matters section 24, mounted beneath the plates 76, below the outward cushion 52 and open below the middle cushion 50 and the inward cushion 48. The pan cover 62 is preferably made of sheet metal and is slightly flexible upward and downward at the forward portion. The bed pan 16 includes a removable liner 84, such as a conventional plastic trash bag.

Figure 5:
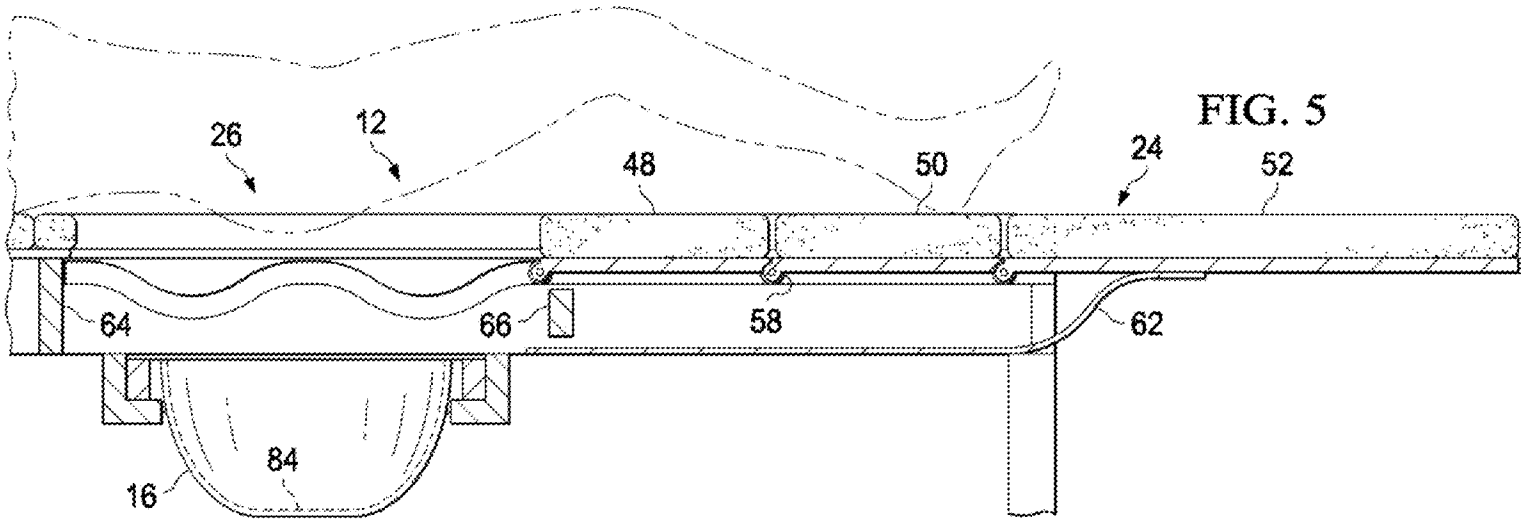

FIG. 5 is a longitudinal section view of the hospital bed 12 taken along section line 4-4 of FIG. 2, after the movable cushions 24 have been moved to an extended position allowing a person in the hospital bed 12 to access the bed pan 16 through the central opening 26.

Figure 6:
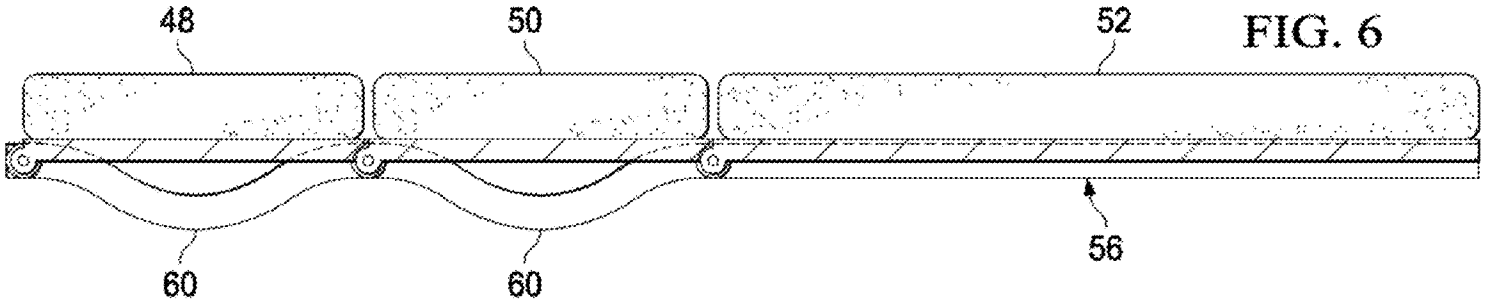
Figure 7:
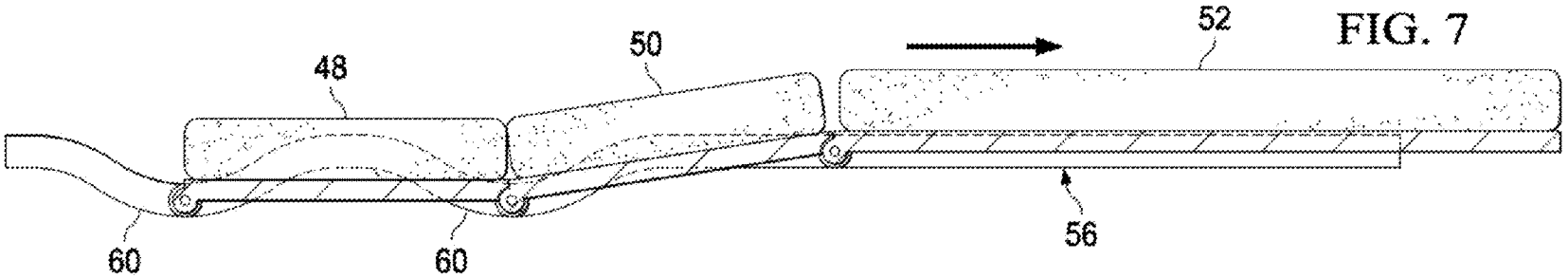

FIG. 6 is a longitudinal section view showing the cushion guide tracks 56 with the movable cushions 24 shown in a fully inserted position. The guide tracks 56 extend in a serpentine fashion, with the double loops 60. FIG. 7 is a longitudinal section view taken along section line 4-4 of FIG. 1, showing the movable cushions 24 partially removed and tracking along the cushion guide tracks 56. The serpentine shape with two semi-circular shaped loops 60 for the guide tracks 56 allow the cushions to move as shown in FIGS. 6 and 7 allows the inward cushion 48 and the middle cushion 50 to extend downward and from beneath a person on the hospital bed 12. The cushion guide tracks 56 extend in a straight line rearward from the forward terminal end of the outward cushion 52 when disposed in the forward position covering the opening 26.

Figure 8:
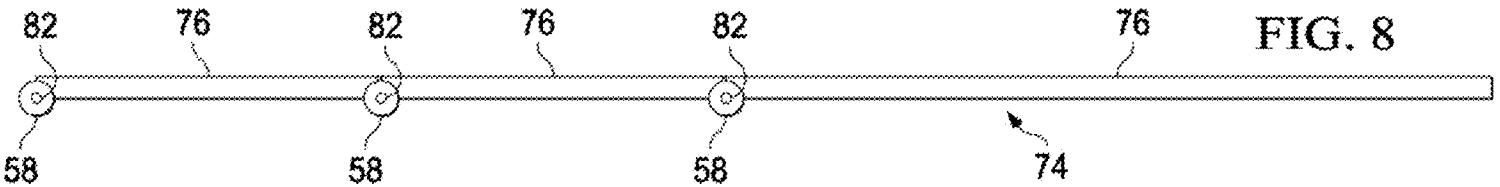

FIG. 8 is a partial side elevation view of the plate segments 70 for supporting the movable cushions 24 in the hospital bed 12. The plates 80 are secured together with adjacent edges pivotally joined together.

Figure 9:
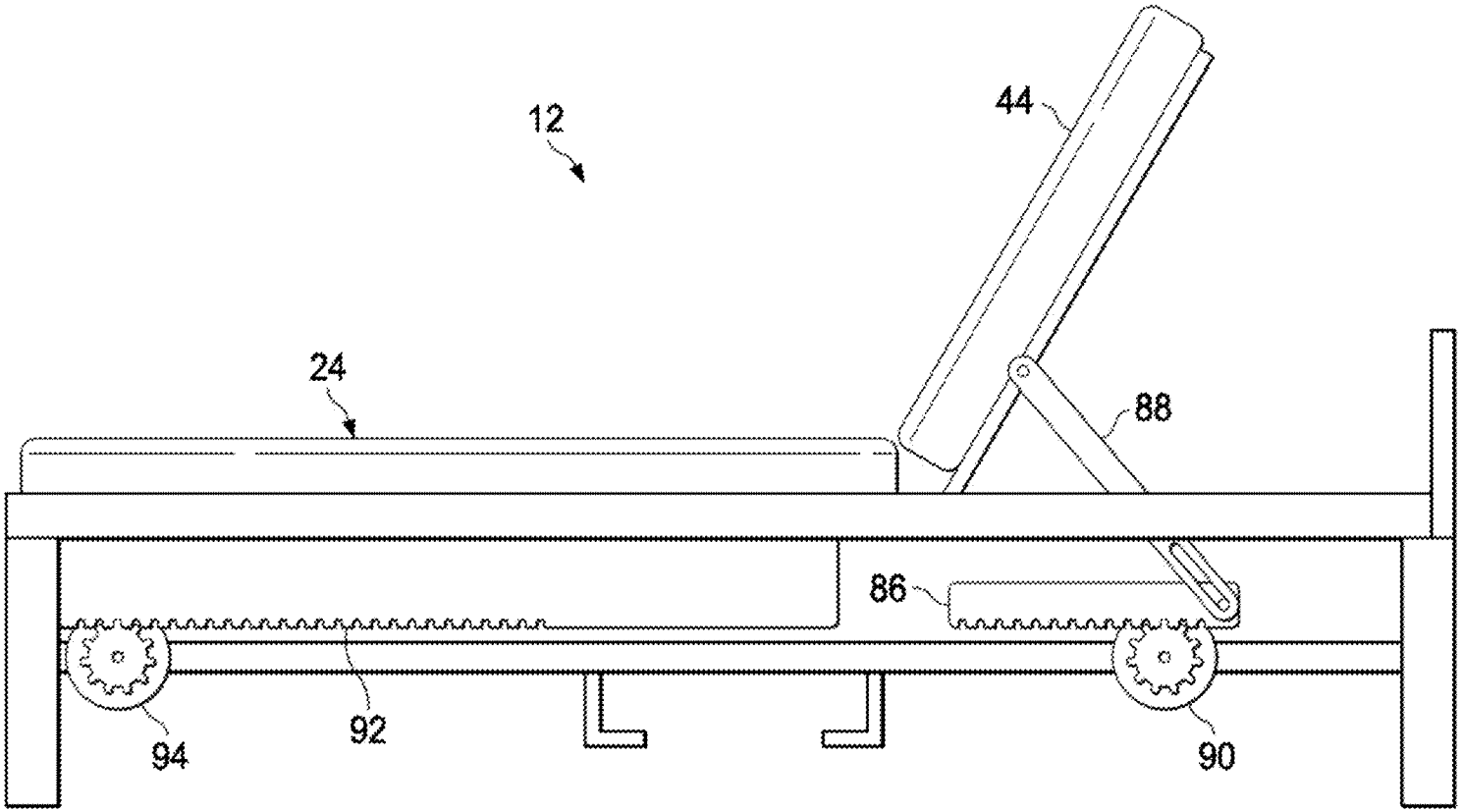

FIG. 9 is a side elevation view of an embodiment of the hospital bed 12, having a top cushion 44 for angularly moving to an upright position to support a person in an upright position on the hospital bed 12. A connecting member 88 is connected between a base portion for the top cushion 44 and a linear gear 86. A motor 90 is provided for angularly raising and lowering the top cushion 44. Similarly, a linear gear 92 is mounted beneath the moveable cushions 24 and engages a pinion gear for the motor 94 for moving the moveable cushions between the retracted and extended positions.

Figure 10:
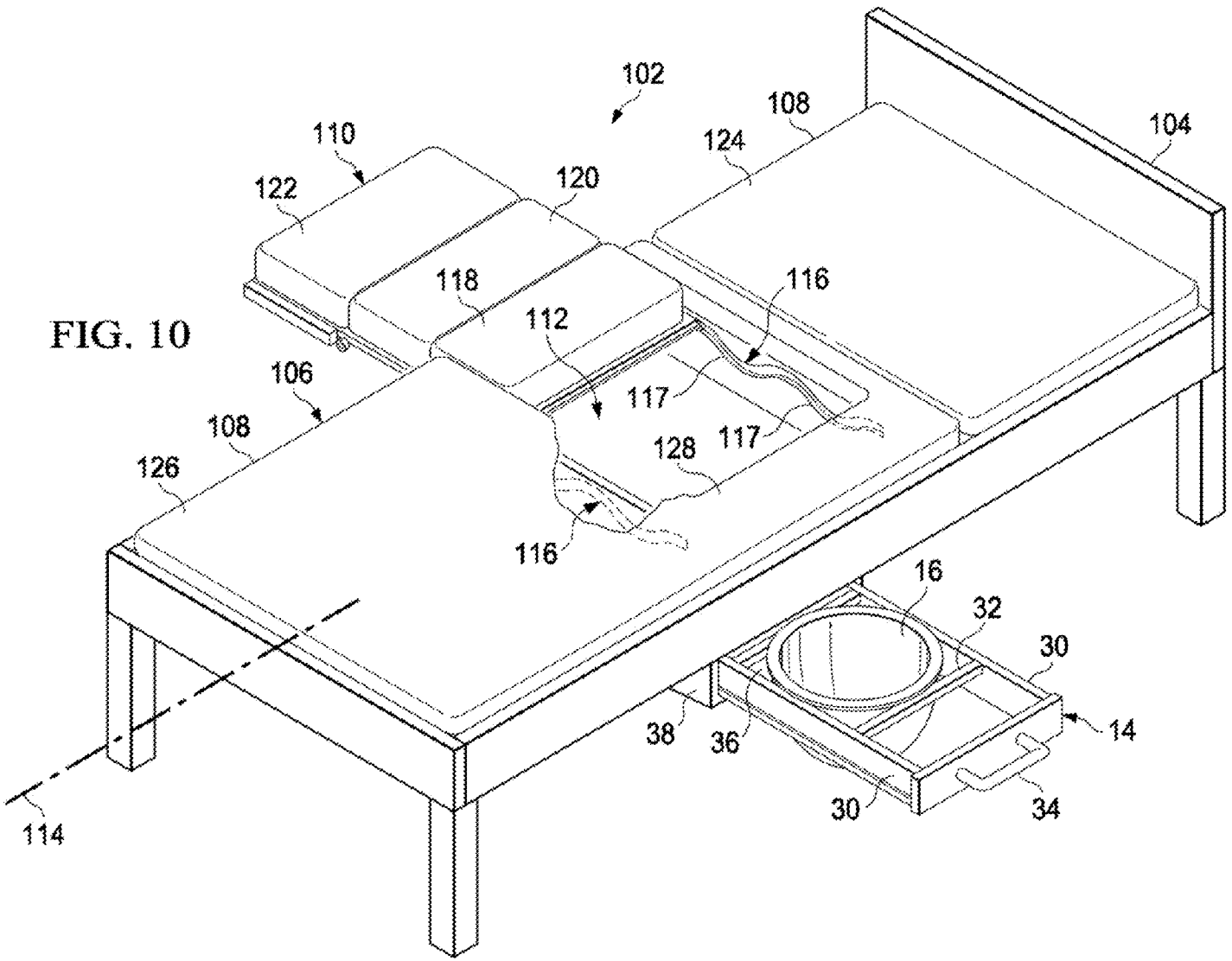

FIG. 10 is a perspective view of the hospital bed 102 of an alternative embodiment the present invention. The hospital bed 102 has a bed frame 104 supporting an alternative mattress 106. The hospital bed 102 includes the drawer 14 and the removable bed pan 16 which slidably extend from the side of the bed 102, transverse to a central longitudinal axis 114 of the bad 102. The mattress 106 includes stationary cushions 108 and moveable cushions 110 which slide outward from a central portion of the mattress to expose a central opening 112. The moveable cushions 110 slidably move between an inward position and an extended position, shown in FIG. 10, along a direction which is transverse to the central longitudinal axis 114. Similar to the guide tracks 56 shown in FIGS. 1, 6 and 7, cushion guide tracks 116 are provided with serpentine shapes having double loops 117 to allow the cushions to move as shown in FIGS. 6 and 7, such that the inward cushion 118 and the middle cushion 120 extend downward and from beneath a person on the hospital bed 12, as shown in FIGS. 6 and 7 for guide tracks 56. The cushion guide tracks 116 preferably extend in a straight line to the outward side of the inward terminal end of the outward cushion 122 when disposed in the forward position covering the opening 112. The guide tracks 116 may be provided by rails, such as elongate rods spaced apart from sides of the bed 102, or U-shaped grooves formed into sidewalls of the bad 102.

Preferably, the stationary cushions 108 of the mattress 106 include a stationary top cushion 124 and a stationary lower cushion 126. A stationary side portion 128 is preferably provided by an upper end of the lower cushion 126. A patient may roll onto and be supported by the stationary side portion 128 as the moveable cushions 110 are moved outward to expose the central opening 112 and the bed pan 16, or the inward cushion 118 and the middle cushion 120 may be moved from beneath the patient as discussed above in reference to the cushion guide tracks 116 and FIGS. 6 and 7 in reference to cushion guide tracks 56. The hospital bed 102 preferably has the cushion rollers 58, a pan cover plate 62, a forward splash plate 64, a rearward splash plate 66, a side splash plate 68 and a side splash plate 70 as discussed above in reference to the hospital bed 12.

Figure 11:
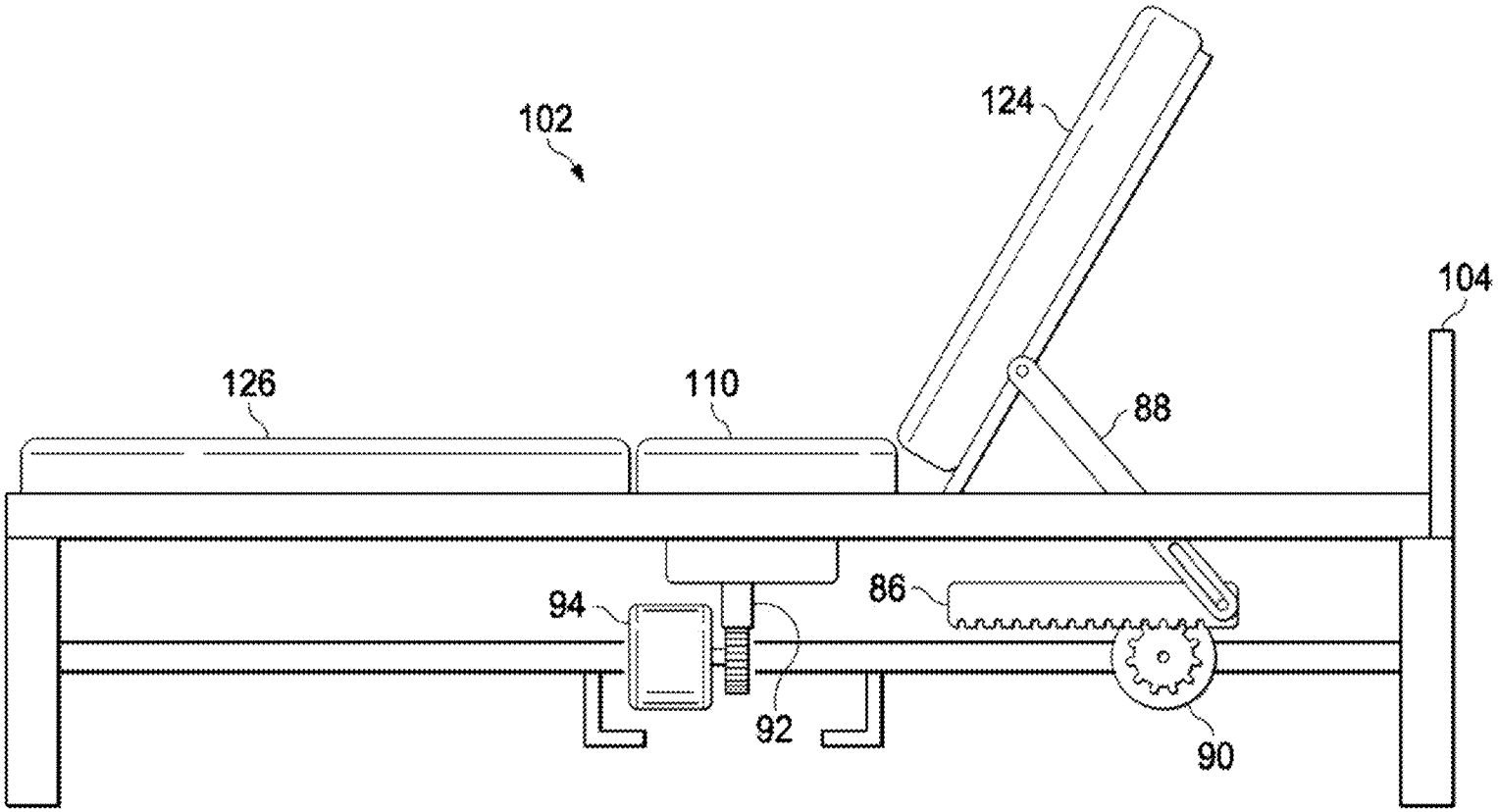

FIG. 11 is a side elevation view of the alternative embodiment of the hospital bed 102 showing the top cushion 124 after angularly moving from a downward position shown in FIG. 10 to the upright position shown in FIG. 11. A connecting member 88 is connected between a base portion for the top cushion 124 and a linear gear 86. The motor 90 is provided for angularly raising and lowering the top cushion 124. Similarly, a linear gear 92 is mounted beneath the moveable cushions 110 and engages a pinion gear for the motor 94 for moving the moveable cushions between the retracted and extended positions.

Figure 12:
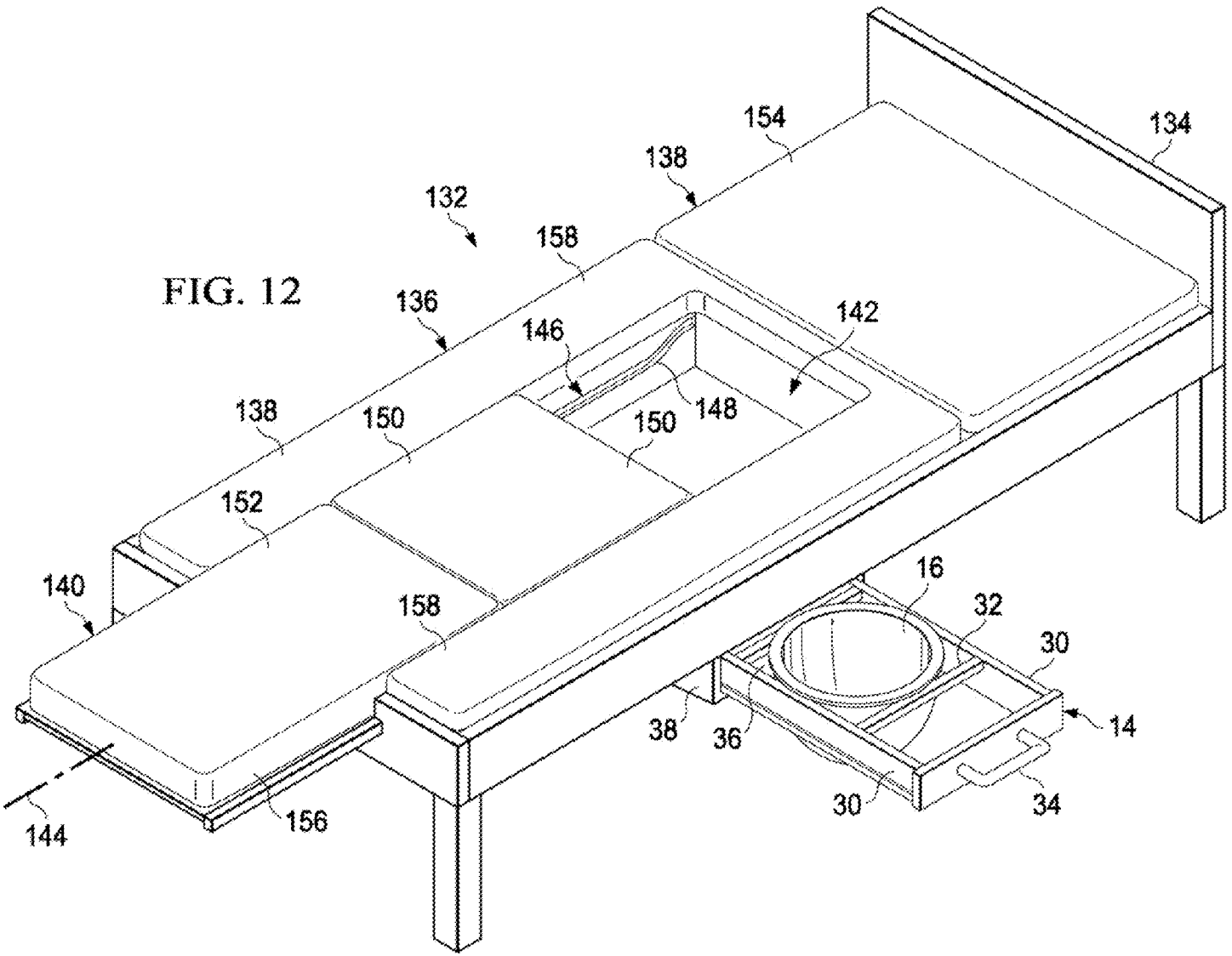
FIG. 12 is a perspective view of the hospital bed of the present invention.

FIG. 12 is a perspective view of the hospital bed 132 of the present invention. The hospital bed 132 has a drawer 14 which slidably extends outward from the side of the hospital bed 132. The drawer 14 moves transverse the central longitudinal axis 144. A removable bed pan 16 is removably mounted within the drawer 14. The bed has a frame 134 to which a mattress 136 is mounted. The mattress 136 includes a plurality of stationary cushions 138 and moveable cushions 140. The moveable cushions 140 slidably extend from along a horizontal plane and the central longitudinal axis 144 to extend rearward or outward from the foot of the bed 132, to expose a central opening 142. The central opening 142 is located in a mid-section of the hospital bed 132. The bed pan 16 may be accessed through the central opening 142. The drawer 14 preferably has drawer slides 30 with a rack frame 32 defining a pan aperture 36 within which the removable bed pan 16 is removably received. A pull handle 34 is provided on the outward side of the drawer 14. Drawer mounts 38 are provided for slidingly securing the drawer 14 within the bed 12 by means of the drawer slides 30.

The stationary cushions 138 of the mattress 136 include side cushions 158 and a top cushion 154 for supporting the upper torso of a person. The moveable portion of the mattress 136 include an inner cushion 150 and an outward cushion 152. Preferably, the inner cushion 150 is much shorter in length than the outward cushion 152 to allow the inner cushion 48 to travel along the cushion guide tracks 146 (one shown) by means of rollers 190 (shown in FIGS. 14 and 15). The cushion guide tracks 146 (one shown) have a single semi-circular loop 148, as opposed to the double loops for the cushion guide tracks 56 of FIG. 1 and 116 of FIG. 10. One loop rather than two is used in the cushions guide tracks 146 since only one inward cushion 150 is provided, as opposed to the two cushion of FIG. 1 which includes the cushion 48 and middle cushion 50 of FIG. 1, and the two cushions of FIG. 10 which includes the inward cushion 118 and middle cushion 120.

Figure 13:
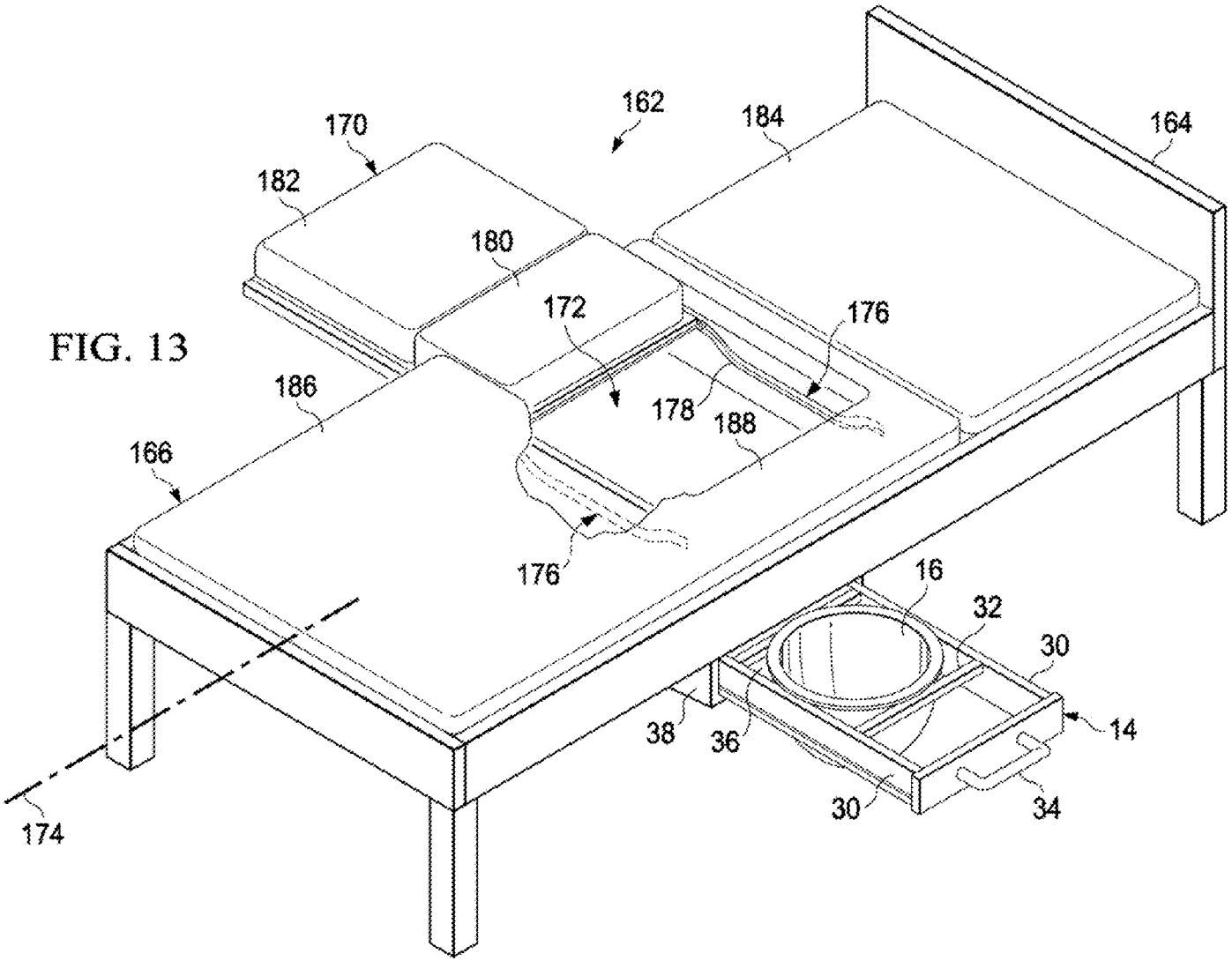
FIG. 13 is a perspective view of the hospital bed of an alternative embodiment the present invention.

FIG. 13 is a perspective view of the hospital bed 162 of an alternative embodiment the present invention. The hospital bed 162 has a bed frame 164 supporting an alternative mattress 166. The hospital bed 162 includes the drawer 14 and the removable bed pan 16 which slidably extend from the side of the bed 162, transverse to a central longitudinal axis 174 of the bad 162. The mattress 166 includes stationary cushions 168 and moveable cushions 170 which slide outward from a central portion of the mattress to expose a central opening 172. The moveable cushions 170 slidably move between an inward position and an extended position, shown in FIG. 13, along a direction which is transverse to the central longitudinal axis 174. Similar to the guide tracks 56 shown in FIGS. 1, 6 and 7, cushion guide tracks 176 are provided with serpentine shapes to allow the cushions to move as shown in FIGS. 6 and 7, such that the inward cushion 178 will extend downward and from beneath a person on the hospital bed 162, as shown in FIGS. 6 and 7 for guide tracks 56. The cushion guide tracks 176 preferably extend in a straight line to the outward side of the inward terminal end of the outward cushion 182 when disposed in the forward position covering the opening 172. The cushion guide tracks 176 (one shown) have a single semi-circular loop 178, as opposed to the double loops for the cushion guide tracks 56 of FIG. 1 and 116 of FIG. 10. One loop rather than two is used in the cushions guide tracks 176 since only one inward cushion 180 is provided, as opposed to the two cushions of FIG. 1 which includes the cushion 48 and middle cushion 50 of FIG. 1, and the two cushions of FIG. 10 which includes the inward cushion 118 and middle cushion 120.

Figure 14:
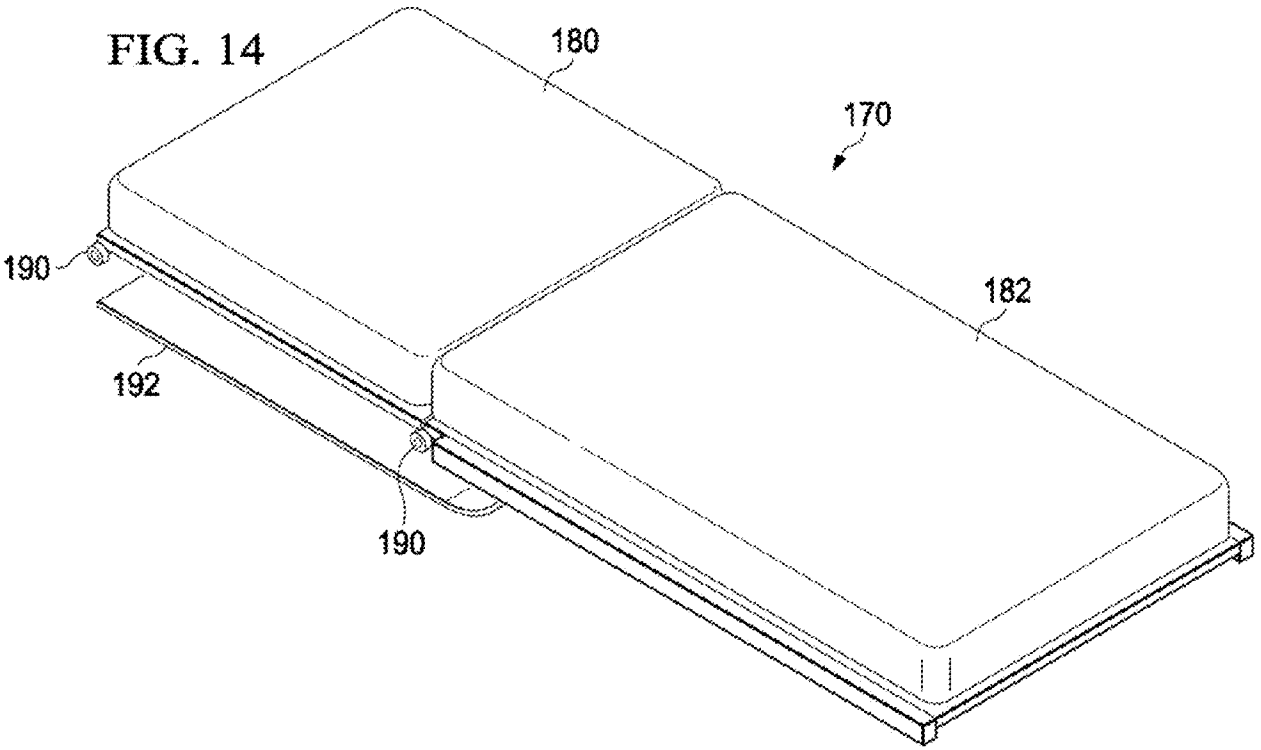
FIG. 14 is a perspective view of a movable cushion portion of a mattress for the removable hospital bed.

FIG. 14 is a perspective view of a movable cushion portion 170 of the hospital bed 162. Adjacent edges of the plates inward cushion 180 and the outward cushion 182 are pivotally secured together. The inner cushion 180 and the outward cushion 182 are mounted to respective ones steel plates, such as the plates 76 shown in FIGS. 2 and 8.

Figure 15:
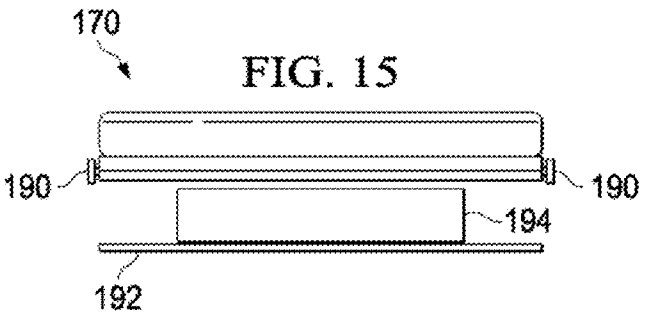
FIG. 15 is a forward end view of the removable cushion portion of FIG. 14.

FIG. 15 is a forward end view of the forward end of the inward cushion 180 of FIG. 14. A splash plate 194 is mounted to the forward end of inward cushion 180. The rollers 190 are shown on opposite sides of the inward cushion 180

The present invention provides advantages of a hospital bed for economical home use and in various care facilities. A stationary portion is provided for supporting a person on the bed as a moveable cushions are moved to uncover a central opening located in a mid-section of the hospital bed. A bed pan is located in a drawer beneath the central opening for receiving waste from the person on the bed. One large bed pan cover is provided to cover the bed pan when the moveable cushions are fully closing the opening in the bed, and two small pan covers are provided for automatically covering the bed pan when the moveable cushions are moved to the open position. A bed pan cover is provided for automatically covering the bed pan when the moveable cushions are moved to cover the central opening.

It should be noted that the term hospital bed is meant to include a bed for use by a person subject to injury or illness and having limited mobility, and is not restricted to beds which are only used in hospitals. A hospital bed according to the present invention may be used in addition to hospitals, in personal residences, rehabilitation facilities, and long term care facilities.

Although the preferred embodiment has been described in detail, it should be understood that various changes, substitutions and alterations can be made therein without departing from the spirit and scope of the invention as defined by the appended claims.

What is claimed is:

1. A hospital bed comprising:

a bed frame;

a mattress disposed on the bed frame, said mattress having stationary cushions and moveable cushions, with said moveable cushions located in a central portion of said mattress and configured for sliding along an axis said hospital bed for accessing a central opening extending through the mattress in a mid-section of said hospital bed;

a drawer mounted beneath said mid-section of said bed, extendable from an inward position to an extended position in which said drawer extends outward of said mid-section of said hospital bed;

a bed pan removable mounted in said drawer, wherein said bed pan is disposed beneath said central opening when said drawer is disposed in said inward position and said bed pan is disposed outward and aside of said mattress when said drawer is disposed in said extended position; and forward and rearward splash plates lining said central opening in said mid-section of said bed.

2. The hospital bed according to claim 1, further comprising a pair of cushion guide tracks, each having a serpentine profile such that at least a portion of said movable cushions are be lowered from beneath the body of a person and then aside of the person for accessing the central opening beneath which said bed pan is disposed when said drawer is inserted fully into said mid-section of said bed.

3. A hospital bed comprising:

a bed frame;

a mattress disposed on the bed frame, said mattress having stationary cushions and moveable cushions, with said moveable cushions located in a central portion of said mattress and configured for sliding along an axis said hospital bed for accessing a central opening extending through the mattress in a mid-section of said hospital bed;

a drawer mounted beneath said mid-section of said bed, extendable from an inward position to an extended position in which said drawer extends outward of said mid-section of said hospital bed;

a bed pan removable mounted in said drawer, wherein said bed pan is disposed beneath said central opening when said drawer is disposed in said inward position and said bed pan is disposed outward and aside of said mattress when said drawer is disposed in said extended position; and a bed pan cover plate extending downward from beneath and moveable with said moveable cushions, said cover plate extending horizontally along a plane for moving with said moveable cushions to cover said bed pan when said moveable cushions are disposed to cover said central opening, and disposed aside of said bed pan when said moveable cushions are disposed aside of said central opening.

4. The hospital bed according to claim 3, further comprising said drawer extending perpendicular to a longitudinal length of said hospital bed.

5. The hospital bed according to claim 3, further comprising:

said moveable cushions including an inward cushion, a middle cushion and an outward cushion, wherein said inward cushion and said middle cushion are moved for covering said central opening;

wherein said drawer extends outward of said mid-section of said hospital bed; transverse to a central longitudinal axis of said hospital bed, said drawer having a bed pan aperture for removable receiving said bed pan; and a plurality of plate segments with each of said moveable cushions mounted to respective ones of said plate segments, wherein said plate segments are disposed edge-to-edge with mating edges pivotally joined together.

6. The hospital bed according to claim 5, further comprising cushion rollers mounted to said plate segments and two spaced apart cushion guide tracks disposed on opposite sides of said central opening, wherein said cushion rollers engage respective ones of said cushion guide tracks for slideably moving said moveable cushions between said retracted and said extended positions, wherein said cushion guide tracks have a serpentine profile for guiding at least part of said moveable cushions from beneath the person on said hospital bed.

7. The hospital bed according to claim 5, further comprising forward and rearward splash plates lining said central opening in said mid-section of said bed.

8. A hospital bed comprising:

a bed frame;

a mattress disposed on the bed frame, said mattress having stationary cushions and moveable cushions, with said moveable cushions located in a central portion of said mattress and configured for sliding along an axis said hospital bed for accessing a central opening extending through the mattress in a mid-section of said hospital bed;

a drawer mounted beneath said mid-section of said bed, extendable from an inward position to an extended position in which said drawer extends outward of said mid-section of said hospital bed;

a bed pan removable mounted in said drawer, wherein said bed pan is disposed beneath said central opening when said drawer is disposed in said inward position and said bed pan is disposed outward and aside of said mattress when said drawer is disposed in said extended position; and a plurality of plate segments with each of said moveable cushions mounted to respective ones of said plate segments, wherein said plate segments are disposed edge-to-edge with mating edges pivotally joined together.

9. The hospital bed according to claim 8, wherein said stationary cushions include two side cushions located on opposite sides of said moveable cushions.

10. The hospital bed according to claim 8, further comprising:

cushion rollers mounted to said plate segments and two spaced apart cushion guide tracks disposed on opposite sides of said central opening, wherein said cushion rollers engage respective ones of said cushion guide tracks for slideably moving said moveable cushions between said retracted and said extended positions.

11. The hospital bed according to claim 10, wherein said cushion guide tracks have a serpentine profile for guiding at least part of said moveable cushions from beneath the person on said hospital bed.

12. The hospital bed according to claim 8, further comprising:

wherein said drawer extends outward of said mid-section of said hospital bed, transverse to a central longitudinal axis of said hospital bed, said drawer having a bed pan aperture for removable receiving said bed pan; and a bed pan removable mounted in said drawer, wherein said bed pan is disposed beneath said central opening when said drawer is disposed in said inward position and said bed pan is disposed outward and aside of said mattress when said drawer is disposed in said extended position.

13. The hospital bed according to claim 12, further comprising a bed pan cover plate extending downward from beneath and moveable with said moveable cushions, said cover plate extending horizontally along a plane for moving with said moveable cushions to cover said bed pan when said moveable cushions are disposed to cover said central opening, and disposed aside of said bed pan when said moveable cushions are disposed aside of said central opening.

14. The hospital bed according to claim 12, further comprising said drawer extending perpendicular to a longitudinal length of said hospital bed.

15. The hospital bed according to claim 12, further comprising a pair of cushion guide tracks, each having a serpentine profile such that at least a portion of said movable cushions are be lowered from beneath the body of a person and then aside of the person for accessing the central opening beneath which said bed pan is disposed when said drawer is inserted fully into said mid-section of said bed.

16. The hospital bed according to claim 12, further comprising cushion rollers mounted to said plate segments and two spaced apart cushion guide tracks disposed on opposite sides of said central opening, wherein said cushion rollers engage respective ones of said cushion guide tracks for slideably moving said moveable cushions between said retracted and said extended positions.

17. The hospital bed according to claim 16, wherein said cushion guide tracks have a serpentine profile for guiding at least part of said moveable cushions from beneath the person on said hospital bed.

18. The hospital bed according to claim 12, further comprising forward and rearward splash plates lining said central opening in said mid-section of said bed.

* * * * *